US006193363B1

(12) United States Patent
Kelly

(10) Patent No.: US 6,193,363 B1
(45) Date of Patent: Feb. 27, 2001

(54) INK JET PRINTING APPARATUS WITH AIR PURGE FUNCTION

(75) Inventor: Kieran B. Kelly, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/300,794

(22) Filed: Apr. 27, 1999

(51) Int. Cl.[7] ..... B41J 2/175
(52) U.S. Cl. ..... 347/86
(58) Field of Search ..... 347/84, 85, 86, 347/87, 49, 92, 93

(56) References Cited

U.S. PATENT DOCUMENTS

| | | | | |
|---|---|---|---|---|
| 4,303,929 | * | 12/1981 | Blanck | 347/86 |
| 5,621,445 | | 4/1997 | Fong et al. | 347/87 |
| 5,719,610 | | 2/1998 | Scheffelin | 347/86 |
| 5,812,168 | | 9/1998 | Pawlowski, Jr. et al. | 347/92 |
| 5,841,454 | | 11/1998 | Hall et al. | 347/87 |
| 5,870,126 | * | 2/1999 | Kondo et al. | 347/92 |
| 5,900,896 | * | 1/2000 | Barinaga et al. | 347/86 |
| 5,984,462 | * | 11/1999 | DeFilipis | 347/86 |
| 6,010,212 | * | 1/2000 | Yamashita et al. | 347/86 |

* cited by examiner

*Primary Examiner*—N. Le
*Assistant Examiner*—Michael Nghiem

(57) ABSTRACT

An ink jet printing system with a pen body having a first chamber and a second chamber. A print head on the pen body is connected to the second chamber, and an ink-transmissive barrier separates the second chamber from the first chamber. A pump is connected to the pen body in communication with the first chamber, and operates to generate a positive pressure in the first chamber to motivate ink from the first chamber, through the barrier, and into the second chamber. An ink supply cartridge may be provided that removably connects to the pen body, and which has openings in registration with corresponding openings in the pen body into the first and second chambers, respectively. A sliding shutter or other valve may be provided on each of the pen body and the cartridge to close the openings when the cartridge is removed from the pen body. An actuator portion of the cartridge may operate to engage the pump upon installation of the cartridge, and to displace any gas bubble from the second chamber to the supply cartridge; upon disengagement of the cartridge, the actuator may release the pump, drawing ink from the cartridge into the first chamber.

25 Claims, 8 Drawing Sheets

INK JET PRINTING APPARATUS WITH AIR PURGE FUNCTION

FIELD OF THE INVENTION

This invention relates to ink jet printers, and more particularly to ink jet printers with replaceable ink supplies.

BACKGROUND AND SUMMARY OF THE INVENTION

Ink jet printers employ print heads that reciprocate over a media sheet and expel droplets onto the sheet to generate a printed image or pattern. In some ink jet printers, an ink supply connected to the print head reciprocates along with the print head. To reduce operating costs, some ink jet printers use ink supplies that are separately replaceable, so that the print head is not discarded when an ink supply is depleted. The connection between such a print head and replaceable ink supply faces some difficulties.

First, it is important to make a disconnectable fluid connection between the ink supply and the print head that does not leak, either when the components are connected to each other, or when separated for ink supply replacement. A connection should be repeatable without degradation, readily aligned or tolerant of misalignment, compact, reliable, and inexpensive.

A second concern with removable ink supplies involves the introduction of gas into the print head. Gas may be introduced by way of ink containing dissolved gas that outgasses in a print head chamber, or due to air entrapped upon connection of an ink supply. Gas bubbles can block the flow of ink, and can lead to ink degradation, drying, or crusting.

Existing supply/print head interface systems may employ a foam-filled ink supply, and a mesh covered conduit on the print head that presses against the foam. While effective, foam systems reduce the volumetric efficiency of the supply cartridge, are subject to ink crusting at the openings when the components are separate, and are vulnerable to leakage without additional sealing.

Other contemplated systems for a supply/print head interface involve the use of a needle and septum, with a hollow needle on the print head, and a septum on the ink supply sealing the opening. This requires additional sealing to prevent the needle from drying out when the supply is removed, and the system tends to be more bulky and complex than would be most desirable. The septums may be damaged or deformed, with a particular concern involving an inexperienced user repeatedly reinstalling a single ink supply due to a lack of confidence about whether the installation was correct. Further, such systems are intolerant of moderate misalignments, and rely on elastomeric components that can be troublesome to procure.

The present invention overcomes the limitations of the prior art by providing an ink jet printing system with a pen body having a first chamber and a second chamber. A print head on the pen body is connected to the second chamber, and an ink-transmissive barrier separates the second chamber from the first chamber. A pump is connected to the pen body in communication with the first chamber, and operates to generate a positive pressure in the first chamber to motivate ink from the first chamber, through the barrier, and into the second chamber. An ink supply cartridge may be provided that removably connects to the pen body, and which has openings in registration with corresponding openings in the pen body into the first and second chambers, respectively. A sliding shutter or other valve may be provided on each of the pen body and the cartridge to close the openings when the cartridge is removed from the pen body. An actuator portion of the cartridge may operate to engage the pump upon installation of the cartridge, and to displace any gas bubble from the second chamber to the supply cartridge; upon disengagement of the cartridge, the actuator may release the pump, drawing ink from the cartridge into the first chamber.

DETAILED DESCRIPTION OF A PREFERRED EMBODIMENT

Figure 1:
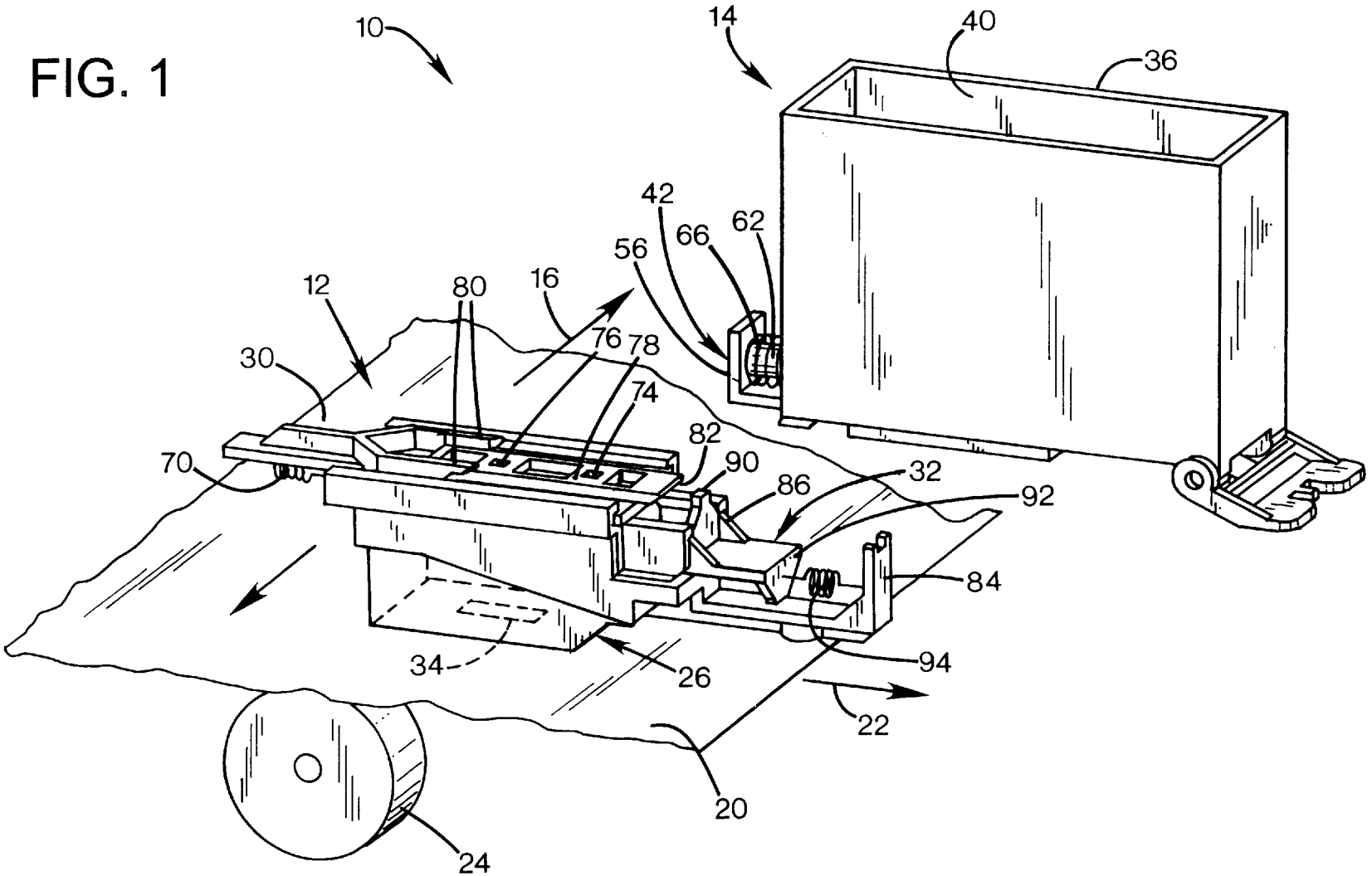
FIG. 1 is a perspective view of a printing apparatus according to a preferred embodiment of the invention.

FIG. 1 shows an ink jet printing system 10 having a pen assembly 12 and a removable ink supply cartridge 14. The pen assembly is mounted to a carriage (not shown) that reciprocates along a scan axis 16 above a media sheet 20. The media sheet is advanced along a feed axis 22 by a feed mechanism 24.

The pen assembly 12 has three major moving parts. A pen body 26 is fixed with respect to the carriage, a sliding pen shutter 30 is slidably connected to an upper portion of the body, and a pump element 32 reciprocates with respect to the body as will be discussed in detail below. An inkjet print head 34 is connected to a lower surface of the pen body.

Figure 2:
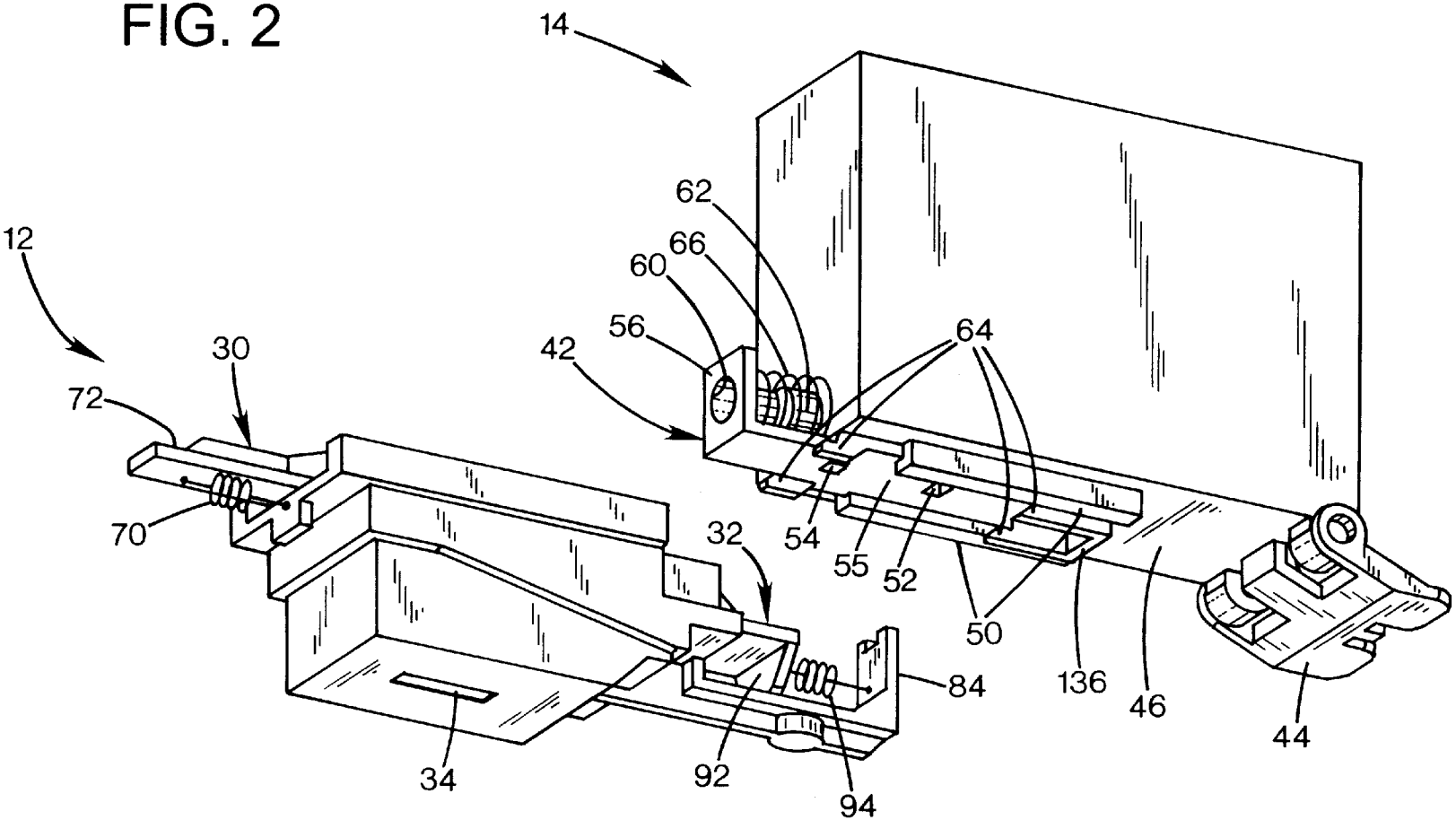
FIG. 2 is a perspective view of the printing apparatus of FIG. 1.

The ink supply cartridge 14 includes a body 36 defining an ink chamber 40, which is fully enclosed (except for some form of vacuum relief valve or mechanism), but which is shown open at its upper end for illustration purposes. A cartridge shutter 42 is slidably connected to a lower portion of the body, and a latch 44 is pivotally attached to a lower end of the body. As shown in FIG. 2, the cartridge shutter 42 is an elongated planar body that rests flat against the flat lower surface 46 of the cartridge. The shutter is held tightly against the lower surface by a pair of rails 50, which constrain motion of the shutter to the single linear degree of freedom along the length of the shutter.

The shutter defines a first opening 52 and a second opening 54, which are spaced apart and aligned on the median of the shutter. The shutter has a flat, smooth lower surface 55 in the regions of the openings so that each opening is entirely surrounded by the planar surface. At a free end of the shutter, in what will be described as the insertion direction, a flange portion 56 extends upwardly. The flange defines an aperture 60 for closely receiving a cylindrical boss 62 that extends horizontally from the exterior of the cartridge body in the insertion direction. The shutter includes four engagement feet 64 extending downward and in the insertion direction for engaging the shutter of the pen body, as will be discussed below. Each foot has a toe portion with a sloped upper surface that provides a wedging function when it engages a similar and oppositely oriented element on the pen shutter. The shutter 42 is spring biased toward the insertion direction by a coil compression spring 66 that encompasses the boss 62, pressing apart the shutter flange from the cartridge body.

The pen shutter 30 is spring biased toward an extraction direction opposite the insertion direction by a tension spring 70, which connects an extending portion 72 of the pen shutter to an exterior surface of the pen body facing the insertion direction. Referring back to FIG. 1, the pen shutter 30 defines a first opening 74 and a second opening 76, which respectively correspond to the first and second openings 52, 54 of the cartridge shutter, and which have similar size and spacing so that they are in registration when the two shutters are engaged. The shutter has a flat, planar upper surface 78, particularly those portions entirely surrounding each of the openings. The pen shutter includes two upwardly protruding feet 80 adjacent the second shutter opening 76, and a tapered ledge 82, all extending in the extraction direction and having sloped lower surfaces that facilitate engagement of the two shutters, and to compress together the respective flat surfaces 55 and 78 to provide a fluid-tight seal about the openings.

As further shown on FIG. 1, the pen body has a stanchion 84 that protrudes upwardly from a rearwardly extending portion of the body. The pump element has an intermediate portion 86 that is captured in a channel in the pen body, and which has an upstanding actuator portion 90. A tail portion 92 of the pump element is connected to the pen stanchion 84 by way of a tension spring, which biases the pump to the illustrated retracted position.

Figure 3:
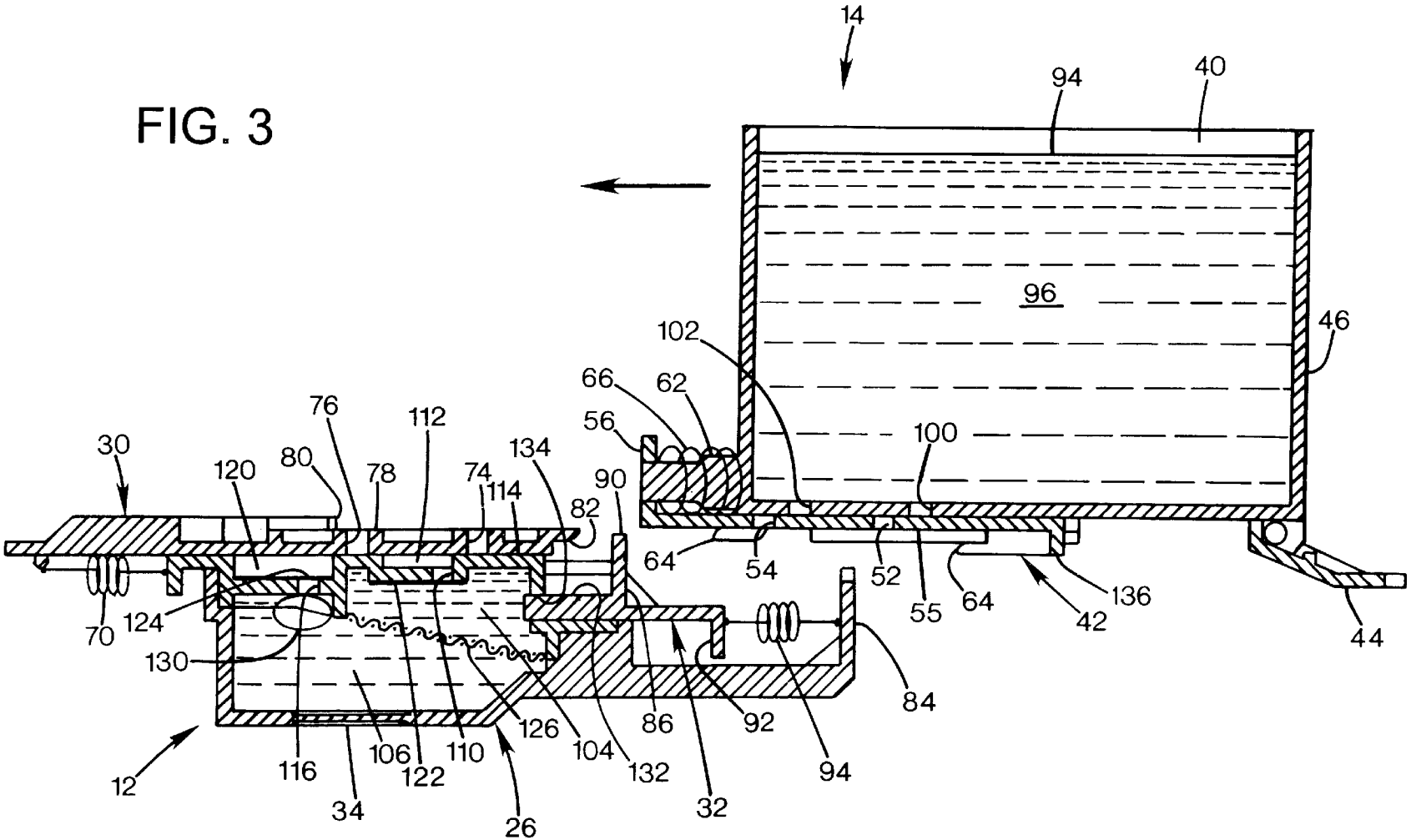
FIGS. 3–8 are sectional side views of the printing apparatus of FIG. 1 showing a sequence of operations.

As shown in FIG. 3, the ink cartridge 14 is shown just prior to installation on the pen 12, with the ink chamber 40 filled to a full level 94 with ink 96. At the lower wall of the cartridge body, a pair of cartridge openings 100, 102 are spaced apart and sized similarly to the shutter holes 52, 54. With the cartridge shutter 42 in the closed position illustrated, the cartridge openings 100, 102 are closed because the shutter openings are offset. As will be illustrated below, when the shutter is moved to an open position, the openings align, and fluid flow into and out of the chamber is provided. In either position, and in intermediate positions, the flat upper surface of the shutter and flat lower surface of the cartridge body prevent fluid from escaping between the components.

The pen body 26 defines a first chamber 104 and a second chamber 106. At the upper surface of the pen body, a first aperture 110 connects to the first chamber 104 and opens to a first elongated basin 112 that is recessed below a flat pen body upper surface 114. A second aperture 116 connects to the second chamber 106 and opens to a second elongated basin 120 that is recessed below the upper surface 114, and which is separate from the first basin 112. The basins are positioned co-linearly along the midline of the pen shutter, and are spaced apart on-center comparably to the spacings of the apertures 110, 116, and of the shutter openings 74, 76.

The first aperture 110 is covered at its lower opening by a reed-type check valve 122 that admits fluid into the first chamber from above, but which prevents fluid from escaping the first chamber. The second aperture 116 is covered at its upper opening in the basin 120 by a reed-type check valve 124 that admits fluid into the basin from the second chamber below, but which prevents fluid from entering the second chamber by way of the opening 116. Both check valves are normally closed, so that ink or air do not leak into or out of the pen when pressures are at equilibrium, such as when there is no ink supply cartridge installed.

The first chamber 104 and second chamber 106 are separated from each other by a porous mesh barrier 126, such as is commonly used in existing ink jet devices. The mesh barrier has openings sized to prevent passage of anticipated contaminant particles. The mesh also serves to prevent passage of gas bubbles when wetted by ink. The barrier 126 is positioned largely beneath the first chamber and above a portion of the second chamber. It is tilted at an angle from the horizontal, and slopes upward toward the second aperture. Thus, an air bubble trapped in the second chamber below the barrier will float upward at an angle toward the opening 116, where it will come to rest as illustrated by bubble 130. Essentially, the upper portion of the second chamber is positioned laterally of part of the first chamber, and entirely above the level of the barrier. It serves as a sump to collect gas bubbles that occur in the second chamber.

The pump element 32 has a piston element 132 that is closely received in a pump aperture 134 in a wall of the first chamber. The piston element has a constant rectangular cross section that maintains a fluid-tight seal with the wall as it reciprocates between the extended position shown, and a compressed position in which a major portion of the piston extends into the first chamber. Thus, the pump effectively changes the volume of the first chamber. Upon compression, it displaces unfiltered ink, which becomes filtered as it passes through the mesh barrier into the second chamber (and thereby expelling the gas bubble and/or ink out of the second chamber as discussed below); upon extension, it draws fluid into the first chamber via the first opening 110.

Figure 4:
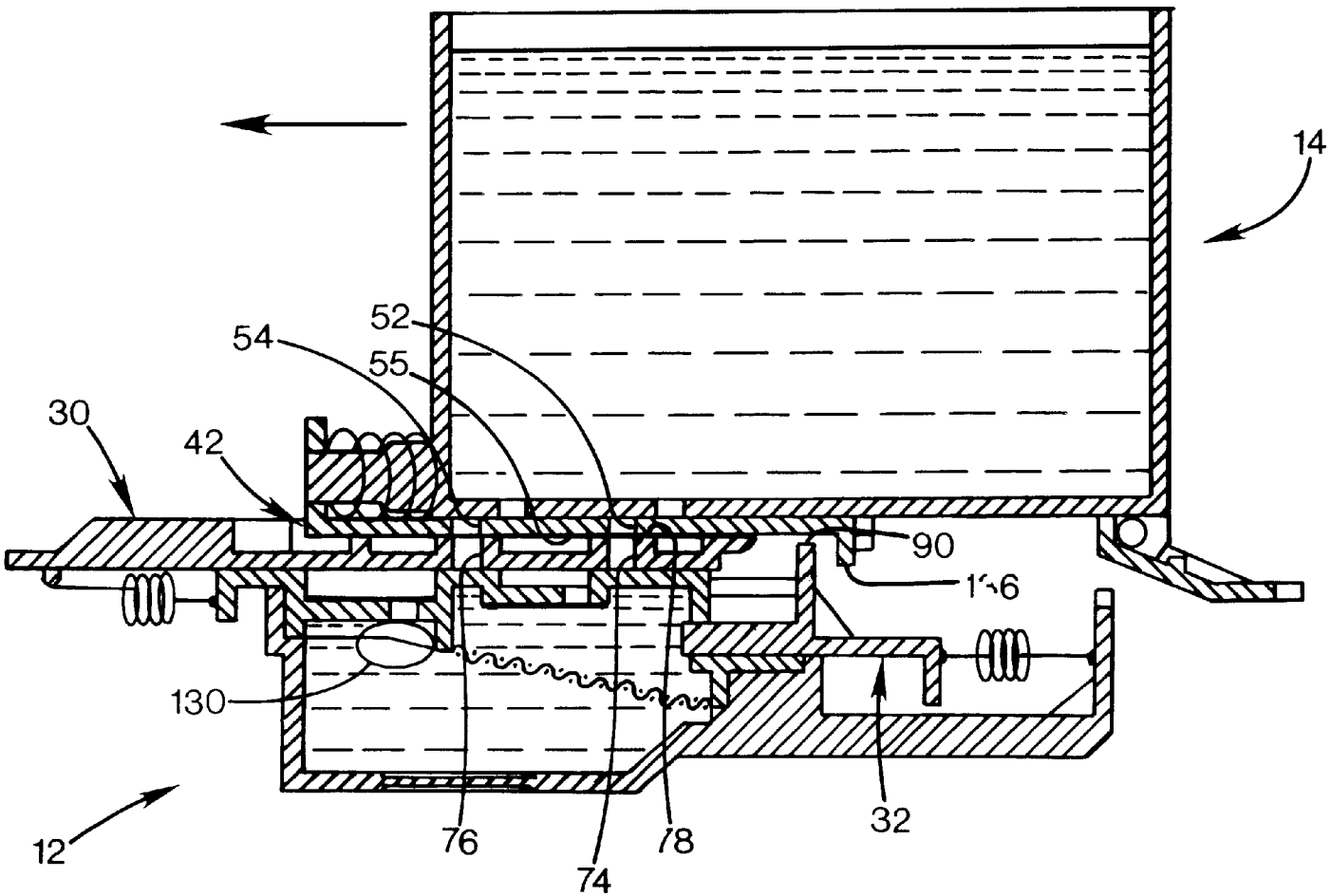

FIG. 3 shows an initial condition in which the cartridge is not yet connected to the pen. In FIG. 4, the cartridge is in an initial stage of connection with the pen. The cartridge has been advanced in the insertion direction until the cartridge shutter 42 is fully engaged to the pen shutter 30. In the engaged condition, the shutter surfaces 55 and 78 are fully abutting around the shutter openings 52, 54, 74, 76. In this condition, the shutters are essentially connected as a single unit, and the contact surrounding the openings prevents leakage of ink at the seam of contact. The shutters are held in close contact by the engagement of the feet 64 of the cartridge shutter, with the feet 80 and ledge 82 of the pen shutter. The slopes at the toes of each foot prevent the toes from stubbing against each other, and provide a camming action that compresses the shutters together.

In the FIG. 4 condition, the ink supply is full, and the pen chambers are filled with ink, except for the presence of the bubble 130. Each shutter is in a closed position as biased by the respective springs, so that the openings of the shutter are offset from the respective openings of the pen body and the cartridge. A tail portion 136 of the cartridge shutter remains spaced apart from the pump actuator 90, and the pump remains in the extended position allowing maximum first chamber volume.

Figure 5:
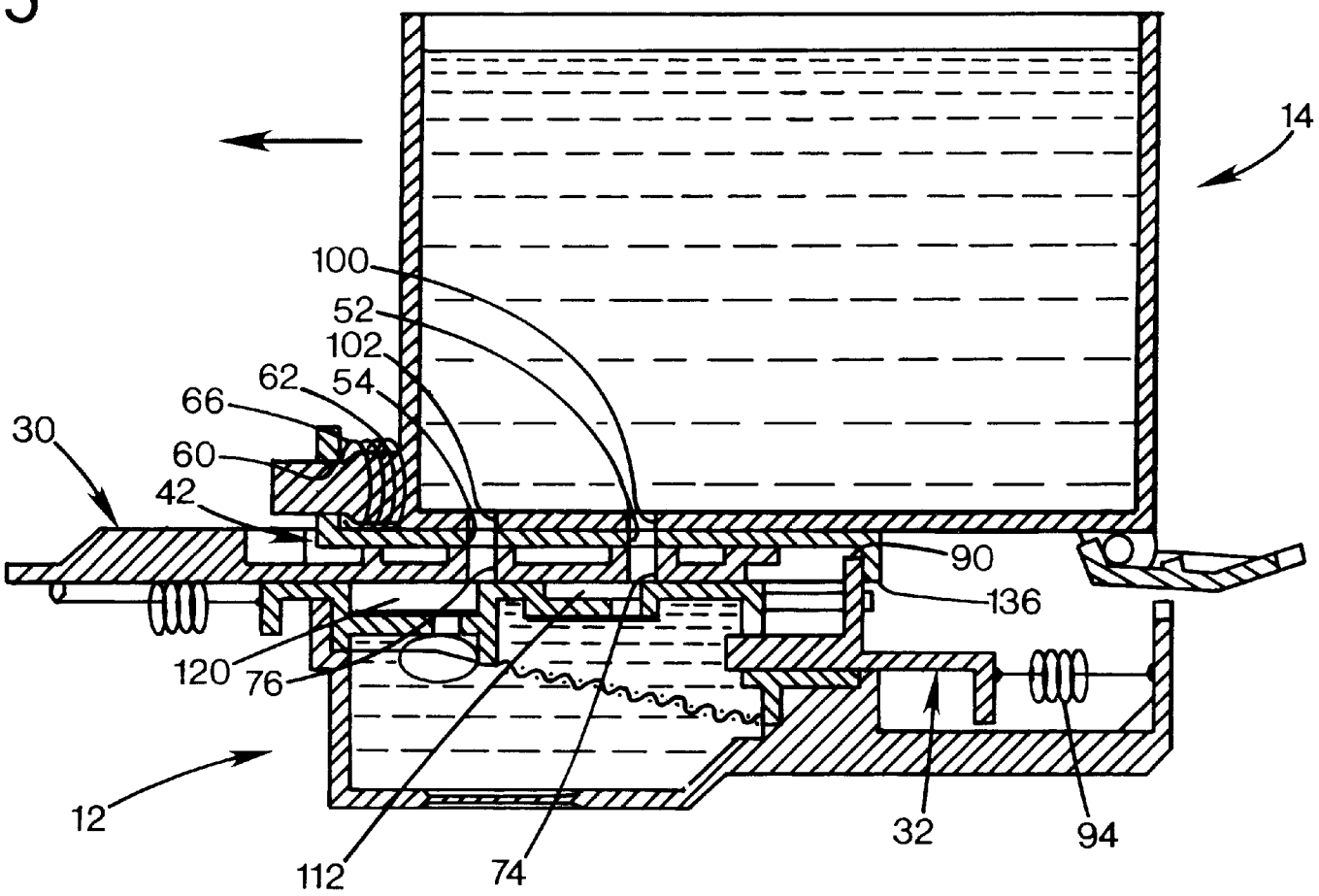

In FIG. 5, cartridge installation proceeds, with the cartridge tail portion 136 having contacted the pump actuator 90, and with cartridge advancement having continued beyond the moment of such contact. Because the spring force of the pen shutter spring 70 is greater than that of cartridge shutter spring 66, the further cartridge movement causes the cartridge to move relative to the momentarily immobilized cartridge shutter, compressing spring 66 and bringing the cartridge apertures 100, 102 into registration with shutter openings 52, 54. With the cartridge shutter fully open, limited by the interaction of the shutter flange hole 60 with a shoulder on the boss, further advancement causes the pen shutter 30 to slide toward an open position. In this position, the pen shutter holes 74 and 76 have just overlapped the pen basins 112 and 120. Thus, in the illustrated moment of installation just prior to actuation of the pump, there are two avenues for fluid communication between the ink supply and the pen chambers, limited only by the check valves, each of which is presently closed in the absence of a pressure differential in the appropriate direction.

Figure 6:
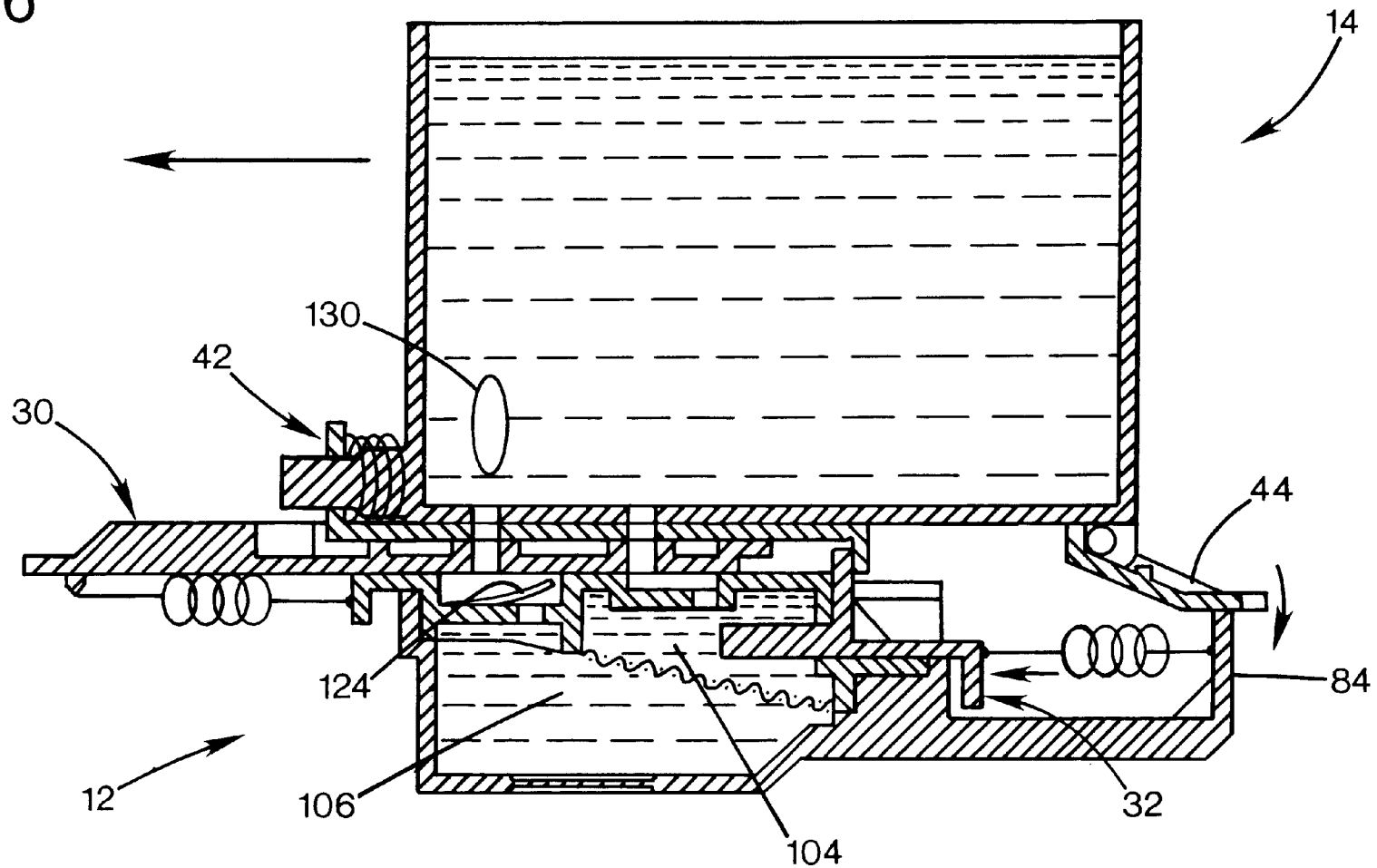

In FIG. 6, the cartridge is fully installed, and the latch 44 has dropped under its own weight to engage the pen stanchion 84, preventing the cartridge from being inadvertently moved from the installed position by the actions of the springs, all of which are providing a maximum biasing force in the installed position. In the installed position, the cartridge shutter 30 and pump 32 have advanced together until the pump has displaced ink from the first chamber 104 into the second chamber 106. Meanwhile, the shutter openings remain in communication with the pen apertures throughout the compression process between the moments of FIGS. 5 and 6. This is possible because the basins have adequate length comparable to the stroke of the pump, and is necessary because at least one of the openings must allow fluid flow to accommodate the volume displacement.

Upon installation, the volume change caused by the pump is accommodated by expulsion of the air bubble 130 from the second chamber, past the check valve 124, and through the openings into the ink chamber of the cartridge; check valve 122 prevents ink flow through the other opening. Preferably, the pump displacement is calculated to be at least as great as the volume of the typical bubble. The displacement may be based in part on expected outgassing by the typical volume of ink in the cartridge over the life of the cartridge. Any pumping of ink back to the cartridge where the bubble is smaller than expected is not a problem, because the recirculated ink will be available for printing. This means that repeated pumping, such as might occur when an inexperienced user repeatedly installs and uninstalls a cartridge, does not waste ink.

When fully installed, printing may proceed until the cartridge contents are depleted. In the preferred embodiment, the printing system uses drop counting or other means to estimate when the cartridge is nearly but not entirely depleted. This prevents "dry firing" of the print head, which can damage a component that is intended to be reused for a multitude of ink cartridges.

Figure 7:
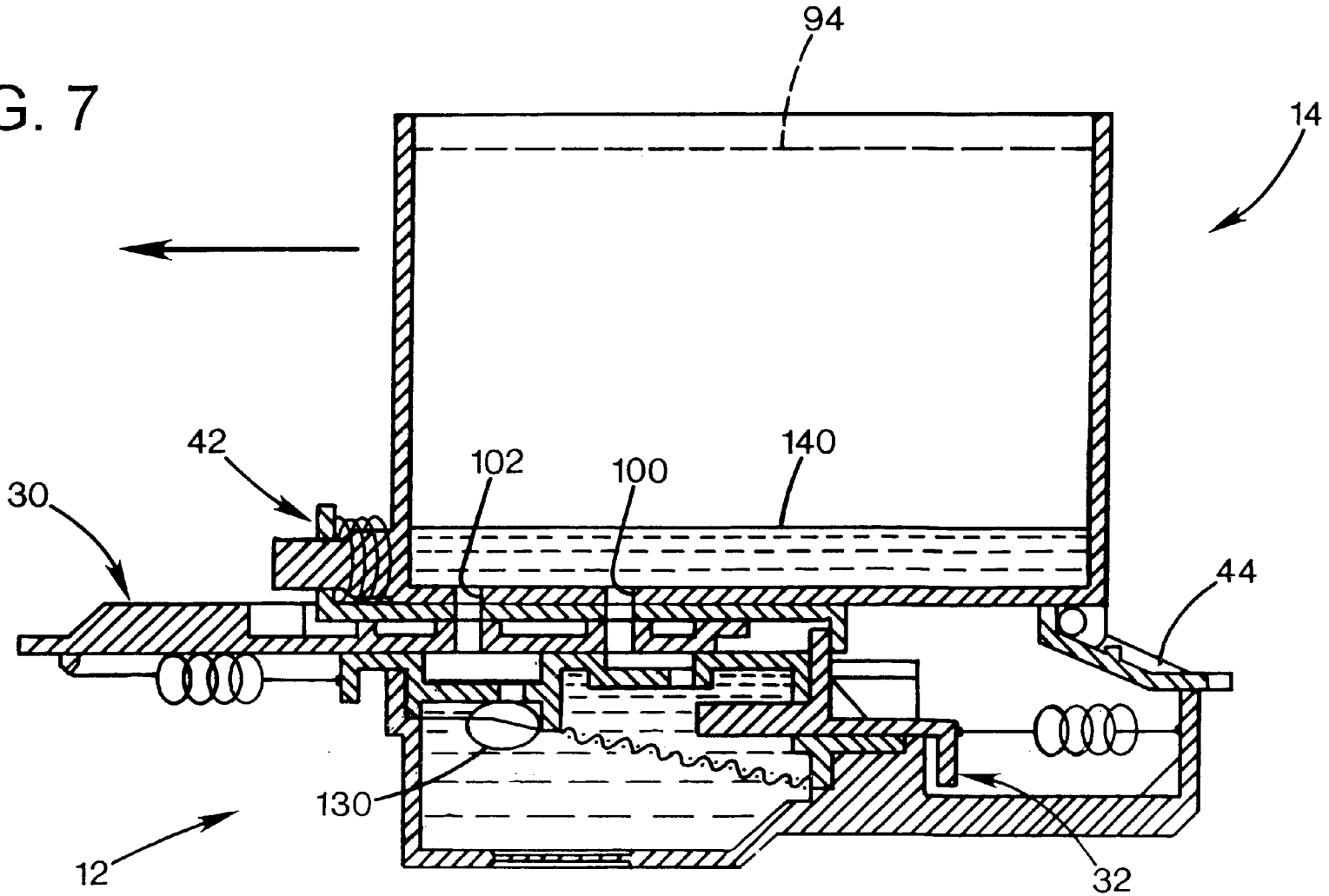

FIG. 7 illustrates the condition in which the ink level has dropped from the full level 94 to a depleted level in which ink remains covering both cartridge apertures 100, 102. Through the process of the printing that has consumed the ink to deplete the cartridge, a new bubble has reformed in the pen, and will eventually be displaced upon installation of the next cartridge as described above. After receiving a signal from the printer, the user begins the process of removing and replacing the functionally depleted cartridge. On removal, the process of installation is reversed, with the sequence of operation of the shutters and pump proceeding in reverse order. The user lifts the latch 44, and extraction is made with the aid of the spring forces, particularly that of the pump spring.

Figure 8:
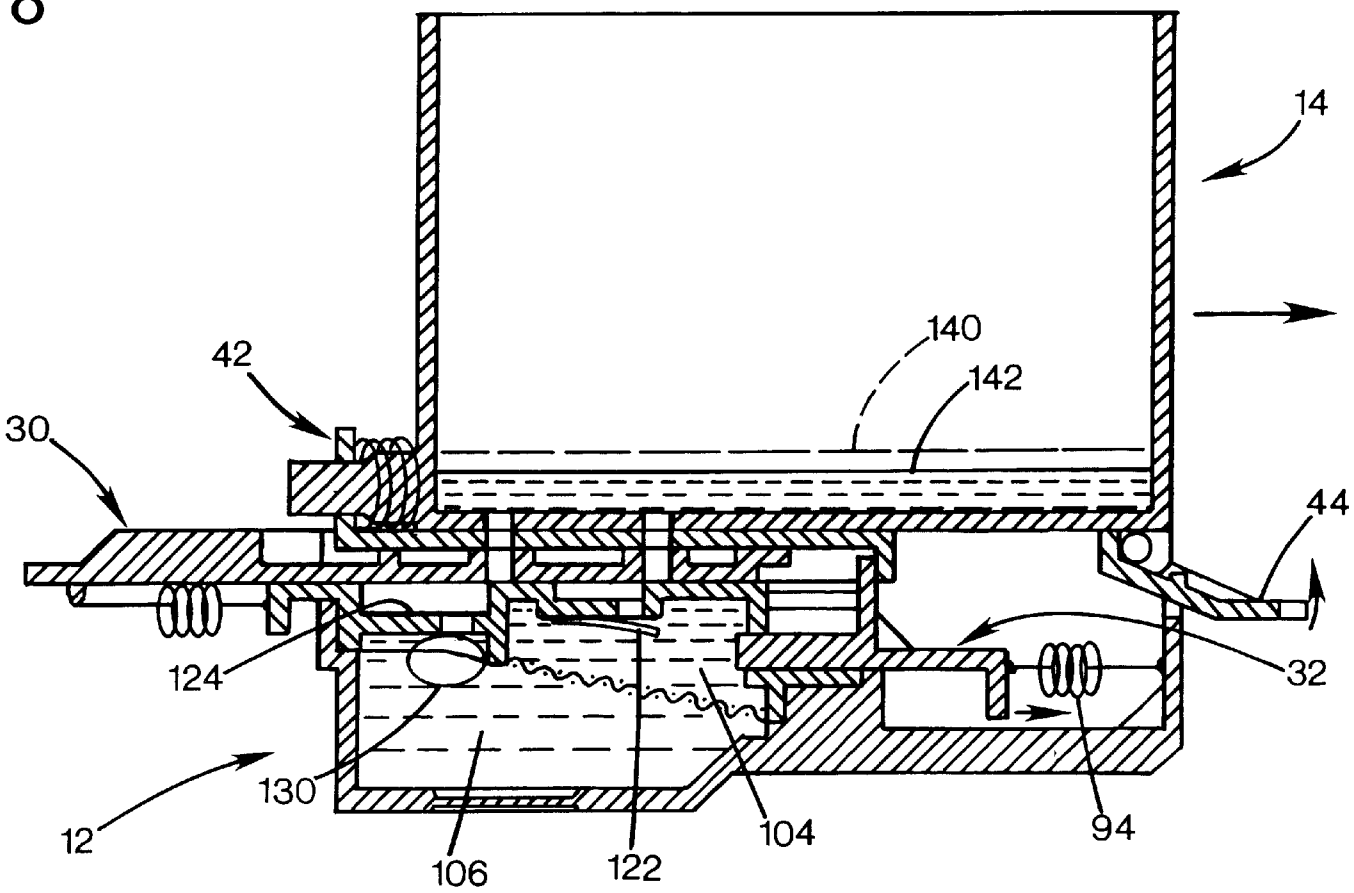

As shown in FIG. 8, the extension of the pump 32 by the pump spring 94 increases the volume of the first chamber 104. The first chamber check valve 122 admits ink from the cartridge supply to fill the enlarged volume, slightly dropping the ink supply from level 140 to level 142. The check valve 124 on the second chamber ensures that unfiltered ink from the supply does not enter the "clean" second chamber, where contaminants might cause clogging of the print head. Throughout the shifting of the pump, the apertures remain open as the shutter apertures pass over the pen basins, as discussed above. In the moment illustrated by FIG. 8, the pump has completed its stroke. As extraction proceeds, the shutters move so that the pen shutter closes off the pen apertures. Then, the cartridge continues moving relative to the shutters to close off the cartridge apertures. Finally, the shutters disengage from each other, and the cartridge is removed.

Until a new cartridge is installed, the pen openings are closed, and only the volume of the pen shutter openings are filled with ink exposed to air. Even if this ink is allowed to dry, it presents no contaminant concern because the second chamber check valve 124 prevents admission of any contaminants to the pen, and the filter barrier prevents contaminants from reaching the print head. Similarly, the small volume of the cartridge shutter openings contains only a minimal amount of exposed ink, limiting the risk of spillage before the depleted pen is disposed of.

An new cartridge is installed as illustrated beginning in FIG. 3 by the same process.

In the preferred embodiment, the shutters, the pump, and the pen and cartridge components that sealably contact the shutters are formed of a hydrophobic material such as Teflon®-filled plastic. This prevents ink from wicking via any microscopic planar gaps between the surfaces. Alternatively, elastomeric gaskets may be used to ensure a good seal in circumstances in which suitable materials or dimensional precision are not attainable. In other alternatives, the pump system may be used without sliding shutters, with the check valves in the pen providing closure, and another set of check valves or the like providing closure of the cartridge apertures. The check valves may be of any suitable type, including duck bill, ball-type, or any other type. The pump is shown as a sliding piston, but may be of any type, including one using a flexible diaphragm to provide a seal. Similarly, an elastomeric gasket or 0-ring may be employed where the use of a hydrophobic pump element material is inadequate to provide a reliable seal.

The spring forces may be changed to select the sequence of operations during installation and removal. It is important that the openings between pen and supply cartridge be open during the entire stroke of pump motion, to avoid expelling ink or ingesting air via the print head. However, In embodiments in which the pump attempts to operate against a sealed chamber, it is believed that this may provide adequate resistance to stop pump actuation until an appropriate opening is available to allow ink flow. Also, it is preferable that the shutters mate before either the pen or cartridge shutters open, preventing ink from leaking between the shutters before they are fully engaged and sealed. Which shutter opens first, or whether the forces are designed so that they open simultaneously is unimportant.

In the preferred embodiment, it has been observed that the following actions occur as the cartridge is installed and moved from a zero position in which the shutters are mated, toward the installed position, and beck to the removed position. Displacement distance are of the cartridge body relative to the fixed pen body.

0.0 mm Shutters engaged, both shutters fully closed, cartridge shutter about to move.

1.0 mm Cartridge apertures begin to open.

2.6 mm Cartridge apertures fully open.

3.6 mm Pen apertures begin to open.

3.8 mm Pump motion begins.

5.2 mm Pen apertures fully open.

8.9 mm Pen shutter stops, pump fully compressed, latch engaged, cartridge fully installed. The pen is operational.

Extraction then begins.

5.2 mm Pen apertures begin to close.

3.8 mm Pump motion ends, fully retracted.

3.6 mm Pen apertures closed.

2.6 mm Cartridge apertures begin to close.

1.0 mm Cartridge apertures closed.

0.0 mm Shutters engaged, both shutters fully closed, cartridge removable.

While the above is discussed in terms of preferred and alternative embodiments, the invention is not intended to be so limited. For instance, the ink that cycles back into the cartridge during pumping may be sent to a waste chamber in systems with ink chemistry that has a limited shelf life, or which is otherwise unsuited to such recycling.

What is claimed is:

1. An ink jet printing system comprising:

a pen body defining a first chamber and a second chamber;

a print head on the pen body in communication with the second chamber;

an ink-transmissive barrier separating the second chamber from the first chamber; and a pump connected to the pen body in communication with the first chamber and operable to generate a positive pressure in the first chamber to motivate ink from the first chamber, through the barrier, and into the second chamber.

2. The apparatus of claim 1 wherein the pen body defines a first opening into the first chamber, and a second opening into the second chamber.

3. The apparatus of claim 2 including a first valve associated with the first opening, and a second valve associated with the second opening.

4. The apparatus of claim 3 wherein the first valve is a check valve permitting ink flow only into the first chamber, and the second valve is a check valve permitting ink flow only out of the second chamber.

5. The apparatus of claim 2 including a pen shutter element slidably mounted to the pen body, the pen shutter element defining a first shutter opening and a second shutter opening and movable between an open position and a closed position, the first and second shutter openings positioned in registration respectively with the first and second openings of the pen body when the shutter is in the open position, and such that the first and second openings of the pen body are closed by the shutter when the shutter is in the closed position.

6. The apparatus of claim 2 wherein the second chamber includes an upper portion in direct communication with the second opening, and at an elevation above at least a portion of the barrier, such that an air bubble below the barrier floats to the upper portion.

7. The apparatus of claim 2 including an ink supply cartridge removably connected to the pen body, the cartridge defining a first cartridge opening in registration with the first pen body opening, and a second cartridge opening in registration with the second pen body opening, the cartridge including valve means for selectably limiting ink flow via the first and second cartridge openings.

8. The apparatus of claim 7 wherein the valve means comprises a cartridge shutter element slidably mounted to the cartridge, the cartridge shutter element defining a first shutter opening and a second shutter opening and movable between an open position and a closed position, the first and second shutter openings positioned in registration respectively with the first and second openings of the cartridge when the shutter is in the open position, and such that the first and second openings of the cartridge are closed by the shutter when the shutter is in the closed position.

9. The apparatus of claim 8 including a pen shutter element slidably mounted to the pen body, the pen shutter element defining a first shutter opening and a second shutter opening and movable between an open position and a closed position, the first and second shutter openings positioned in registration respectively with the first and second openings of the pen body when the shutter is in the open position, and such that the first and second openings of the pen body are closed by the shutter when the shutter is in the closed position, the pen shutter and the cartridge shutter abutting each other, positioned with the first shutter openings in registration with each other, the second shutter openings in registration with each other, and the shutters including means for providing a fluid seal at the openings to contain fluid residing in the openings.

10. The apparatus of claim 7 wherein the cartridge includes an actuator element operably contacting a portion of the pump, such that the pump operates in response to installation and removal of the cartridge from the pen body.

11. The apparatus of claim 1 wherein the ink-transmissive barrier is a screen defining a multitude of openings, such that ink passes through the openings and such that an air bubble does not readily pass through the openings when the screen is wet with ink.

12. The apparatus of claim 1 wherein the ink-transmissive barrier includes a sloped portion oriented in a plane angularly offset from the horizontal, such that an air bubble beneath the sloped portion will be laterally directed by the sloped portion.

13. The apparatus of claim 1 wherein the pump includes displacement means for changing the fluid capacity of the first chamber.

14. The apparatus of claim 1 wherein the pump is a movable piston at least in part defining the first chamber, and movable between a compression position and a withdrawn position, the piston extending at least part way into the first chamber when in the compression position.

15. An inkjet printing system comprising:

a pen body defining a first chamber and a second chamber;

a print head on the pen body in communication with the second chamber;

an ink-transmissive barrier separating the second chamber from the first chamber;

the pen body defining a first opening into the first chamber;

the pen body defining a second opening into the second chamber;

the pen body including a first valve associated with the first opening; and the pen body including a second valve associated with the second opening.

16. The apparatus of claim 15 including a pen shutter element slidably mounted to the pen body, the pen shutter element defining a first shutter opening and a second shutter opening and movable between an open position and a closed position, the first and second shutter openings positioned in registration respectively with the first and second openings of the pen body when the shutter is in the open position, and such that the first and second openings of the pen body are closed by the shutter when the shutter is in the closed position.

17. The apparatus of claim 15 including an ink supply cartridge removably connected to the pen body, the cartridge defining a first cartridge opening in registration with the first pen body opening, and a second cartridge opening in registration with the second pen body opening, the cartridge including valve means for selectably limiting ink flow via the first and second cartridge openings.

18. The apparatus of claim 17 wherein the valve means comprises a cartridge shutter element slidably mounted to the cartridge, the cartridge shutter element defining a first shutter opening and a second shutter opening and movable between an open position and a closed position, the first and second shutter openings positioned in registration respectively with the first and second openings of the cartridge when the shutter is in the open position, and such that the first and second openings of the cartridge are closed by the shutter when the shutter is in the closed position.

19. The apparatus of claim 18 including a pen shutter element slidably mounted to the pen body, the pen shutter element defining a first shutter opening and a second shutter opening and movable between an open position and a closed position, the first and second shutter openings positioned in registration respectively with the first and second openings of the pen body when the shutter is in the open position, and such that the first and second openings of the pen body are closed by the shutter when the shutter is in the closed position, the pen shutter and the cartridge shutter abutting each other, positioned with the first shutter openings in registration with each other, the second shutter openings in registration with each other, and the shutters including means for providing a fluid seal at the openings to contain fluid residing in the openings.

20. A method of operating an ink jet printing system having a pen body defining a first chamber and a second chamber, a print head on the pen body in communication with the second chamber, and a pump connected to the pen body in communication with the first chamber, the method comprising:

connecting to the pen body an ink supply cartridge defining an ink supply chamber;

providing a first fluid path between the ink supply chamber and the first pen chamber;

providing a second fluid path between the ink supply chamber and the second pen chamber; and while connecting the ink supply cartridge, actuating the pump.

21. The method of claim 20 wherein providing first and second fluid paths includes sliding a shutter on the cartridge, and sliding a shutter on the pen body to open passages providing the fluid paths.

22. The method of claim 20 wherein actuating the pump includes operably contacting a portion of the pump with a portion of the cartridge, and moving the cartridge to move the pump portion.

23. The method of claim 20 wherein actuating the pump includes moving a quantity of fluid from the first chamber to the second chamber, and moving a quantity of gas from the second chamber to the ink supply chamber.

24. The method of claim 20 wherein moving a quantity of fluid from the first chamber to the second chamber includes filtering the quantity of fluid.

25. The method of claim 20 including initiating removal of the ink supply cartridge from the pen body, and while moving the cartridge, operating the pump to generate suction in the first chamber to draw fluid from the ink supply cartridge into the first chamber.

* * * * *